US010327621B2

(12) United States Patent
Womack

(10) Patent No.: US 10,327,621 B2
(45) Date of Patent: Jun. 25, 2019

(54) AUTOMATIC SHOE POLISHING DEVICE

(71) Applicant: Michael Womack, Bowie, MD (US)

(72) Inventor: Michael Womack, Bowie, MD (US)

( * ) Notice: Subject to any disclaimer, the term of this patent is extended or adjusted under 35 U.S.C. 154(b) by 68 days.

(21) Appl. No.: 15/679,109

(22) Filed: Aug. 16, 2017

(65) Prior Publication Data

US 2019/0053687 A1 Feb. 21, 2019

(51) Int. Cl.
*A47L 23/02* (2006.01)

(52) U.S. Cl.
CPC ..... *A47L 23/02* (2013.01)

(58) Field of Classification Search
CPC ..... A47L 23/02; G07F 17/22
See application file for complete search history.

(56) References Cited

U.S. PATENT DOCUMENTS 3,557,928 A * 1/1971 Cromwell, Sr. ..... G07F 17/22 15/31
2011/0252585 A1* 10/2011 Lee ..... A47L 23/02 15/30

FOREIGN PATENT DOCUMENTS

WO WO 93/04624 A1 * 3/1993 ..... A47L 23/02
WO WO 2011/096631 A3 * 11/2011 ..... A47L 23/02

* cited by examiner

*Primary Examiner* — Laura C Guidotti

(57) ABSTRACT

An automatic shoe polishing device that comprises a housing cabinet containing components of the automatic shoe polisher that includes a digital control unit implementing multiple cycles of operation to accommodate multiple shoe profiles. At least one brush and spray assembly with a rotating brush and aerosol spray nozzle mounted on a linear moving platform. A shoe tray and track secure a shoe in place and transport a shoe within the device. A plurality of aerosol containers contain at least a cleaner and polisher mixture, with a pneumatic system used to distribute the aerosol mixture using an aerosol spray nozzle and to power at least one lift piston on the shoe tray and track to accommodate the multiple shoe profiles. The digital control unit operates the brush and spray assembly in multiple movement and spraying cycles back and forth to in turn clean and polish a secured shoe.

12 Claims, 6 Drawing Sheets

AUTOMATIC SHOE POLISHING DEVICE

CROSS-REFERENCE TO RELATED APPLICATION(S)

Not applicable

BACKGROUND OF THE INVENTION

1. Field of Invention

The present invention relates to the field of shoe polishers, more particularly to an automatic shoe polishing machine or device for polishing shoes.

2. Description of Related Art

Shoes are a part of most people's wardrobe that receive relatively little attention. For most people, shoe polishing is a tedious process that they undertake rarely or not at all. It is also a manual activity for most people, depending on hands-on manipulation of a shoe and manual application of polish to the shoe. While people will often take clothes to cleaners or wash them in mechanical clothes washers/dryers, they often neglect to devote comparable attention to their shoes.

Generally, polishing a shoe requires a two-step process of applying polish to the shoe and buffing or brushing the polish-coated surfaces of the shoe. Polish can be applied in two methods. A first method sprays a liquid polish onto the shoe, and a second method is to transfer polish from a dispenser onto an applicator brush to apply the polish to the shoe. Both methods typically require manual effort to accomplish.

A primary reason for the relative neglect of an important aspect of a wardrobe is the lack of mechanical cleaning options at the home. There is no analogue available to a mechanical clothes washer and dryer, which is a standard fixture to most American homes, and shoe polishing at home for most people requires considerable manual and/or physical effort.

Based on the foregoing, there is a need in the art for a user-friendly device and system that facilitates hands-off, at home polishing of shoes.

SUMMARY OF THE INVENTION

In an embodiment, an automatic shoe polishing device comprises a housing cabinet containing components of the automatic shoe polisher. A digital control unit implements multiple cycles of operation to accommodate multiple shoe profiles. At least one brush and spray assembly is used comprising a rotating brush and aerosol spray nozzle mounted on a linear moving platform. The shoe tray and track comprises a shoe securing mechanism to secure a shoe in place. A plurality of aerosol containers contain at least a cleaner and polisher mixture. A pneumatic system is used to distribute the aerosol mixture and power the aerosol spray nozzle and to power at least one lift piston on the shoe tray and track to accommodate the multiple shoe profiles, and the digital control unit operates the brush and spray assembly in multiple movement and spraying cycles back and forth along the shoe tray and track to in turn clean and polish a secured shoe.

In an embodiment, the polishing device further comprises an exhaust system to extract fumes from inside the cabinet and help regulate heat in the cabinet.

In an embodiment, the digital control unit stores multiple shoe profiles and a control interface can select an operating cycle to accommodate a shoe profile selected from memory.

In an embodiment, the digital control unit can be used to select and implement an operating cycle to accommodate a shoe profile.

In an embodiment, further comprising the aerosol spray system moving along a travel high and tilt area to cover a top surface of a shoe on the shoe tray and track.

In an embodiment, wherein the aerosol spray system comprises a spray tower and a spray nozzle travel track.

In an embodiment, the plurality of aerosol containers further comprises at least one of a cream and a wax.

In an embodiment, the device further comprises a pressure stem and disk or plate to fit into and secure the shoe.

In an embodiment, the pressure stem and disk or plate further comprises a balloon cloth inflated in the shoe.

In an embodiment, the polishing device includes a heat lamp to provide heat and aid regulating the temperature inside the cabinet during operation.

In an embodiment, the shoe profile includes at least one of height of the shoe; style of the shoe; relative soiling/staining of the shoe; size of the shoe; and color of the shoe.

In an embodiment, a mechanical system substitutes for the pneumatic system and is used to distribute aerosol mixture and to power at least one lift piston on the shoe tray and track to accommodate the multiple shoe profiles.

In an embodiment, an automatic shoe treatment device comprises a digital control unit operating a shoe treatment device according to multiple shoe profiles with at least one brush and spray assembly that comprises a rotating brush and aerosol spray nozzle mounted on a linear moving platform controlled by the digital control unit according to a shoe profile. A plurality of aerosol containers contain a plurality of shoe treating aerosol mixtures to accommodate the multiple shoe profiles with a pneumatic system used to distribute the aerosol mixtures and power the aerosol spray nozzle to spray out, wherein the pneumatic system is controlled by the digital control unit to accommodate the multiple shoe profiles. The digital control unit operates the brush and spray assembly in multiple movement and spraying cycles back and forth along a shoe tray and track securing the shoe to treat the shoe according to a matching shoe profile.

In an embodiment, a second aerosol spray system moves along a travel high and tilt area to cover a top surface of a shoe on the shoe tray and track.

In an embodiment, a mechanical system substitutes for the pneumatic system.

In an embodiment, the digital control unit stores multiple shoe profiles.

In an embodiment, an automatic shoe treatment device comprises a digital control unit storing multiple shoe profiles with at least one brush and spray assembly comprised of a rotating brush and aerosol spray nozzle mounted on a linear moving platform controlled by the digital control unit according to a selected shoe profile. A plurality of aerosol containers contains a plurality of shoe treating aerosol mixtures to accommodate multiple shoe profiles. A pneumatic system is used to distribute the aerosol mixtures and power the aerosol spray nozzle to spray out, wherein the pneumatic system is controlled by the digital control unit to accommodate the multiple shoe profiles. The digital control unit operates the brush and spray assembly in multiple movement and spraying cycles back and forth along a shoe tray and track securing the shoe to treat the shoe according to the matching shoe profile.

In an embodiment, the aerosol spray system further comprises a spray nozzle assembly that moves along a travel high and tilt area to cover a top surface of a shoe on the shoe tray and track.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
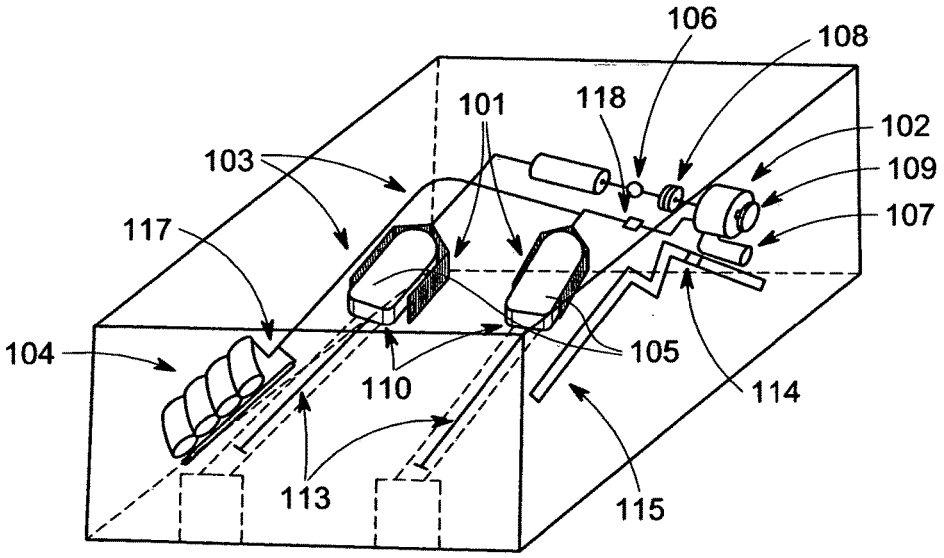
FIG. 1 is a ¾ cutaway view of the automatic shoe polishing device, according to an embodiment of the present invention.

Preferred embodiments of the present invention and their advantages may be understood by referring to FIGS. 1-6, wherein like reference numerals refer to like elements.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

The computer memories in the various disclosed devices may store computer executable instructions. Each disclosed computer/communication device such as computer, a server, a system node, a smart phone, a tablet, or similar device able to execute computer code and/or process digital, electronic data may execute computer executable instructions. The computer executable instructions may be included in computer code. The computer code may be stored in the various device memories. The computer code may be written in any computer language comprising the prior art. The memory may be a non-transitory tangible storage media.

The computer code may be logic encoded in one or more tangible media or one or more non-transitory tangible media for execution by the processor in the devices. Logic encoded in one or more tangible media for execution may be defined as instructions that are executable by the processor and that are provided on the computer-readable storage media, memories, or a combination thereof. Logic may include a software controlled microprocessor, an application specific integrated circuit (ASIC), an analog circuit, a digital circuit, a programmed logic device, a memory device containing instructions, and the like. The instructions may be stored on any computer readable medium comprising the prior art from which a computer, a processor, or other electronic device can read. This may include a computer data disk or the like storing computer code that can be used to configure a memory associated with a computer, a processor, or other electronic device.

The processor may include a general processor, digital signal processor, ASIC, field programmable gate array, analog circuit, digital circuit, central processing unit (CPU), micro-processor unit (MPU), micro-controller unit (MCU), combinations thereof, or other now known processor. The processor may be a single device or combinations of devices, such as associated with a network or distributed processing. The processor may be responsive to or operable to execute instructions stored as part of software, hardware, integrated circuits, firmware, micro-code or the like. The functions, acts, methods or tasks illustrated in the figures or described herein may be performed by the processor executing instructions stored in the memory.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

As depicted in FIG. 1, an automatic shoe polishing device 100 takes the form of a roughly rectangular box-shaped mechanism. FIG. 1 shows the mechanical and electrical components of the shoe polishing device 100 and the relative arrangement of the major components and subsystems. The shoe polishing device 100 can be installed in a cabinet or other housing and can include a pulley system 101 with special brushes designed to move back and forth linearly as the brushes rotate. Drive motor 102 can power the pulley system 101. A shoe 105 can travel back and forth on the pulley system 101, using shoe track/tray 110. A shoe latch 112 can be used to latch a shoe 105 on shoe track/tray 110 or shoe latch can be part of a pressure system to hold a shoe 105 in place. Aerosol lines 103 can transport aerosol wax, cream, polish, and cleaner, and polish from containers to distribution spray nozzles in the device 100, flexing and extending from a reel. Aerosol container 104 can contain various aerosol mixture such as wax, polish, cream, and cleaner to spray from a nozzle. An aerosol container entrance 116 allows for restocking the different aerosol containers 104 on the device 100. Tension pulley 106 can be used to adjust tension on pulley system 101. Vacuum vent 107 can be used as an exhaust from a vacuum system to help keep the interior of the device 100 clean and can include a screen. Clutch 108 can be added as interface between the drive motor 102 and a vacuum wheel 109, and the vacuum wheel 109 can be used in the vacuum/exhaust system that can include an exhaust intake 115 and filter 114. The vacuum/exhaust system can help keep the device 100 interior cleaner and cooler. Exhaust line clean out 118 can allow access to the vacuum/exhaust system. An aerosol wax, cream, cleaner, polish container line tension ride poles 113 can maintain a set tension on moving aerosol lines 103 inside device 100. The spraying of the aerosol mixture can be controlled by spray line cut off 117, such as a solenoid.

Other components of the device 100 can include a digital control unit, a LED or other light heating system to promote better cleaning and shoe shining, a water container on the aerosol lines 103 to use for a purging and cleaning process of the aerosol lines 103. Furthermore, device 100 can include a pneumatic system that includes a small compressor with a storage tank to power a lift system to maneuver a shoe inside the device 100 and facilitate dispensing cleaning, waxing, polishing, or other aerosol substances on the shoe and aerosol line 103 purging. However, mechanical systems can be substituted for the pneumatic driven movement and dispensing system.

The general operation and controls for the automatic shoe polishing device 100 is similar in concept to an automatic car wash using a sequence of operations for general cleaning and applying wax to a shoe followed by polishing. The linear drive provided by the pulley 101 moves a shoe back and forth along a travel reel in contact with rotating brushes. A digital control unit can include a microprocessor executing computer code to operate the device 100, controlling the various aspects of the cleaning and polishing operation. The linear motion feature using brushes attached to a platform can assure full coverage of a shoe. As the brushes rotate (rotary motion), the shoes can move up and down and back and forth to cover the top and sides of a shoe and handle various different shoe profiles. Alternately, the brushes can be moved back and forth with the shoes relatively fixed longitudinally.

Figure 2:
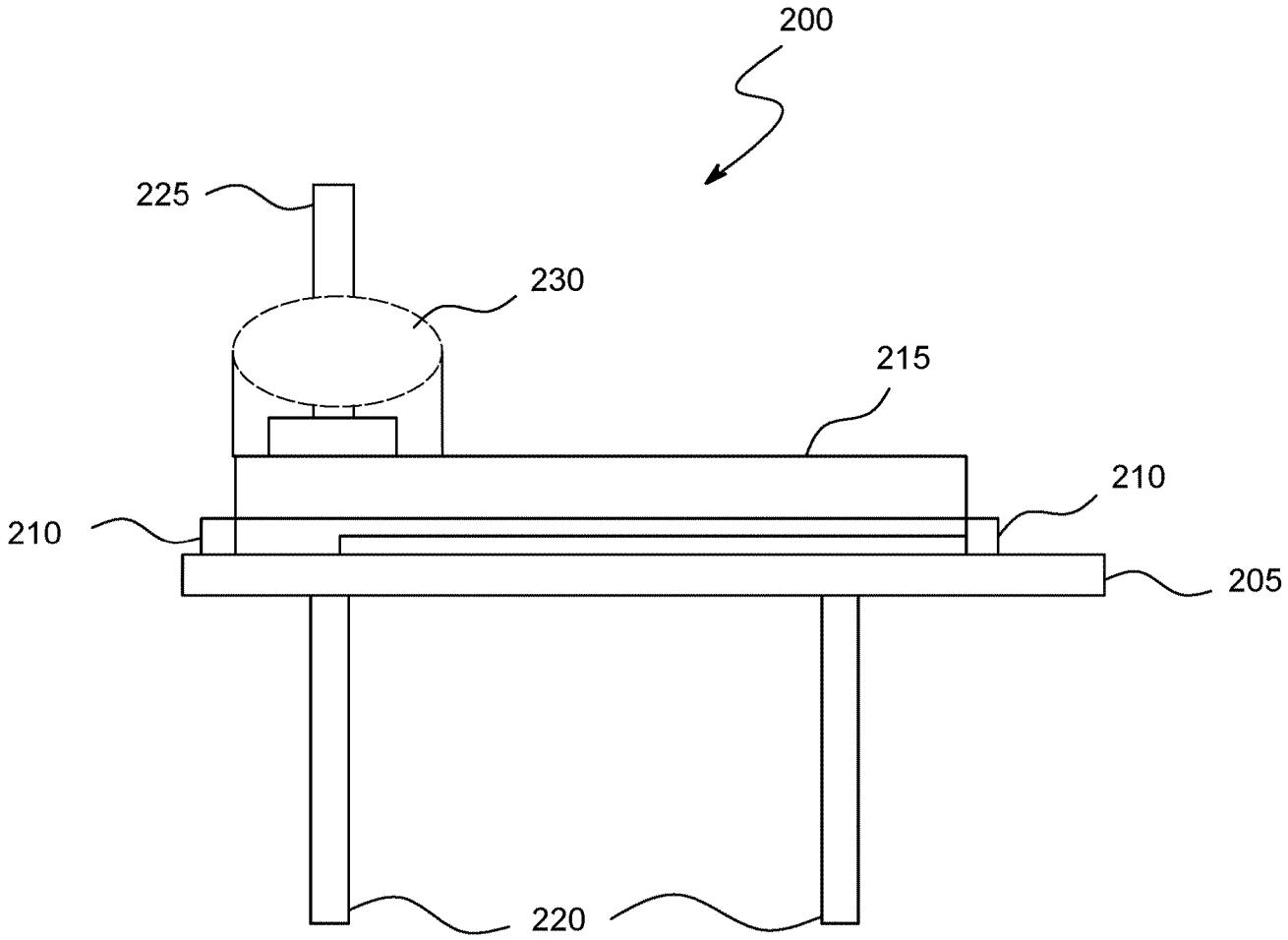
FIG. 2 is a side view of the shoe tray/track, according to an embodiment of the present invention.

As depicted in FIG. 2, the shoe movement and positioning system 200 can included a shoe track/tray 205 designed to move a positioned shoe 215 linearly and vertically. Shoe 215 can be secured to the shoe track/tray 205 using a shoe stop/latching system 210 to firmly secure shoe 215. Shoe track/tray piston 220 can vertically align shoe 215 according to a profile of the shoe 215. The shoe track/tray piston 220 movement can be powered by a pneumatic system that includes a compressor and a storage tank. Pressure stem and stem plate 225 can exert a holding force pushing down against a heel of shoe 215. A balloon cloth 230 can be integrated onto the pressure stem and stem plate 225 to inflate during cleaning and polishing operation to help secure and stabilize shoe 215 on the shoe track/tray 205 aiding the action of shoe stop/latching system 210. Balloon cloth 230 can also protect the interior of shoe 215 from cleaner and wax aerosol from entering the shoe 215.

Figure 3:
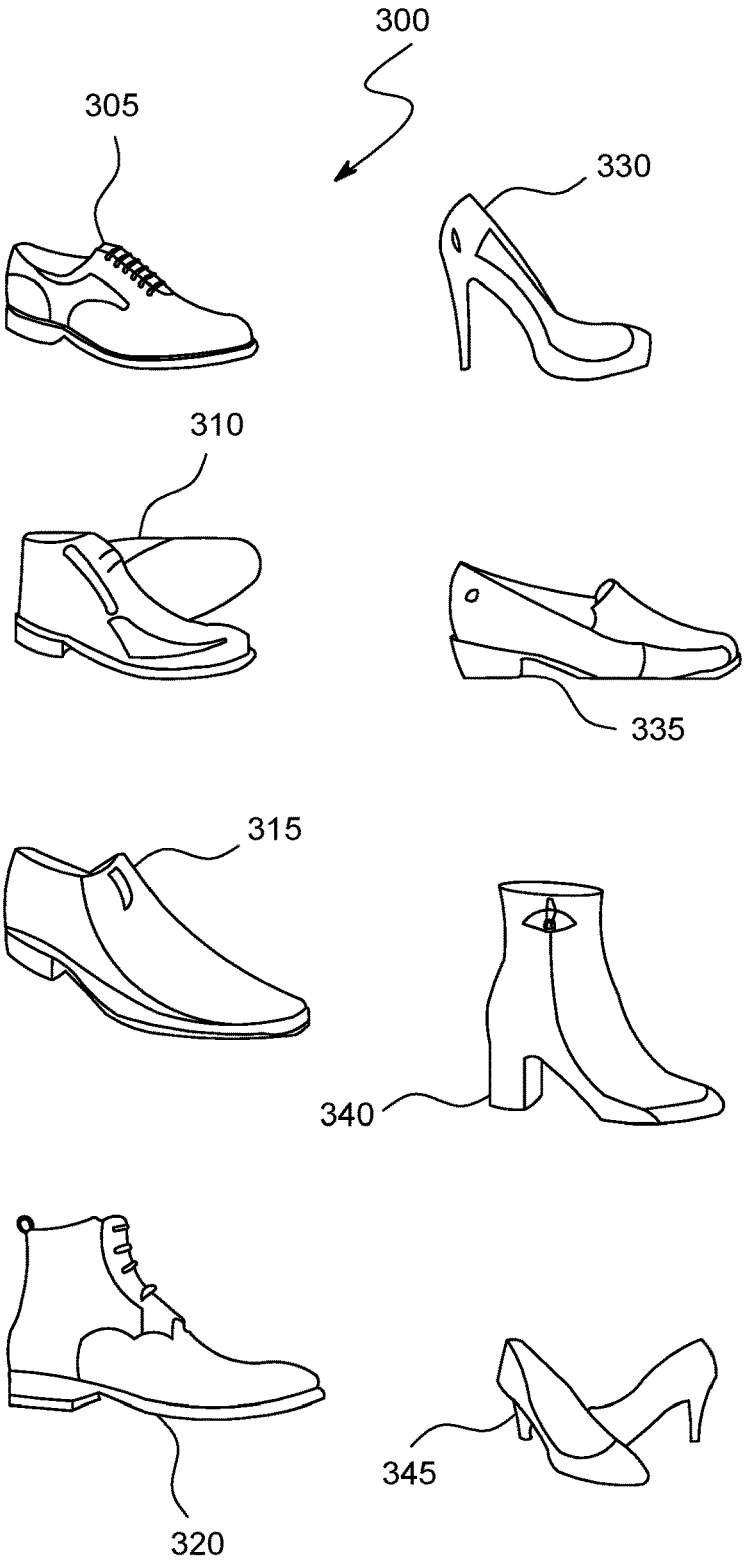
FIG. 3 are views of exemplary shoe profiles used in the device, according to an embodiment of the present invention.

FIG. 3 shows exemplary shoe profiles 300. Shoe profiles 305, 310, 315, and 320 show exemplary male shoe profiles that shoe polishing device 100 can be programmed and configured to accommodate. Low-ankle dress shoe profile 305, high-ankle shoe profile 310, slip-on shoe profile 315, and work boot profile 320 are shown. Shoe profiles 330, 335, 340, and 345 show exemplary female shoe profiles that shoe polishing device 100 can be programmed and configured to accommodate. High-heel shoe profile 330, low-heel shoe profile 335, heeled-dress boot profile 340, and medium-heel shoe profile 345 are shown.

The shoe tray/track 205 can function to lower and rise to accommodate the different shoe profiles 300 so that the spray nozzles and rotary brushes can cover the entire shoe through profile program settings to a digital control unit. The pressure stem with disk/plate 225 can press down on shoe 215 and can be inserted to secure shoe 215 (versus a clamping devise alone) with up force from the shoe tray/track 205 and from movement during linear motion and servicing by brushes in motion. Due to the different shoe profiles 300, there can be a need to insert an assortment of adapters to complete covering of the insole, especially with women shoes and the instep design of women shoes including the heal height of women shoes. A pneumatic air pressure system can be used to control the pressure stem with disk/plate 225.

The control program executed by the digital control unit can include an operational setting and hardware to detect and set a predetermine profile using profile processing/imaging technology to detect and set a shoe profile 300. The shoe tray/track 205 and/or shoe tray/track piston 220 can use a pneumatic air pressure or mechanical system to raise and lower the shoe 210. This can be applied to the shoe stop/latching system 210. The balloon cloth 225 attached to the pressure stem and disk/plate 225 can inflate to fill the insert to protect the insole by preventing solvents from entering the shoe insert (an assortment of balloon may be needed for the different shoe profiles 300).

Alternately, rather than a programmed, predetermined profile, imaging or other scanning hardware and technology can detect actual or approximate shoe design and configuration, or profile, to configure and set the digital control unit. Operational parameters of the device 100 can then be set to properly elevate and otherwise position a shoe 210 for cleaning and polishing as set forth below.

Figure 4B:
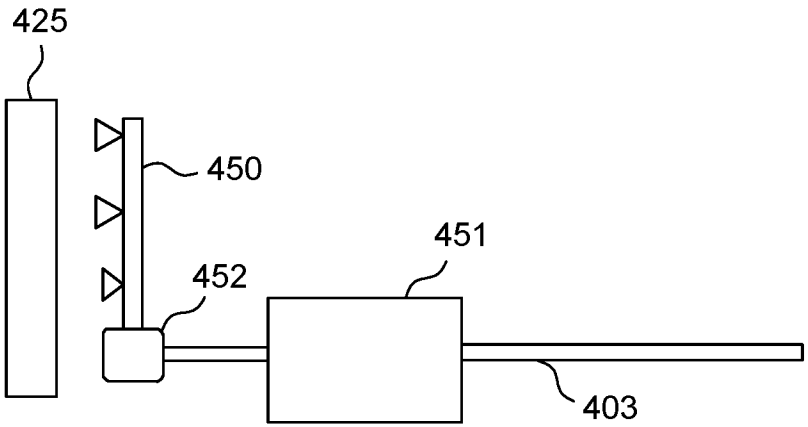
FIG. 4A and FIG. 4B are top and side view of a spray nozzle system, according to an embodiment of the present invention.
Figure 4A:
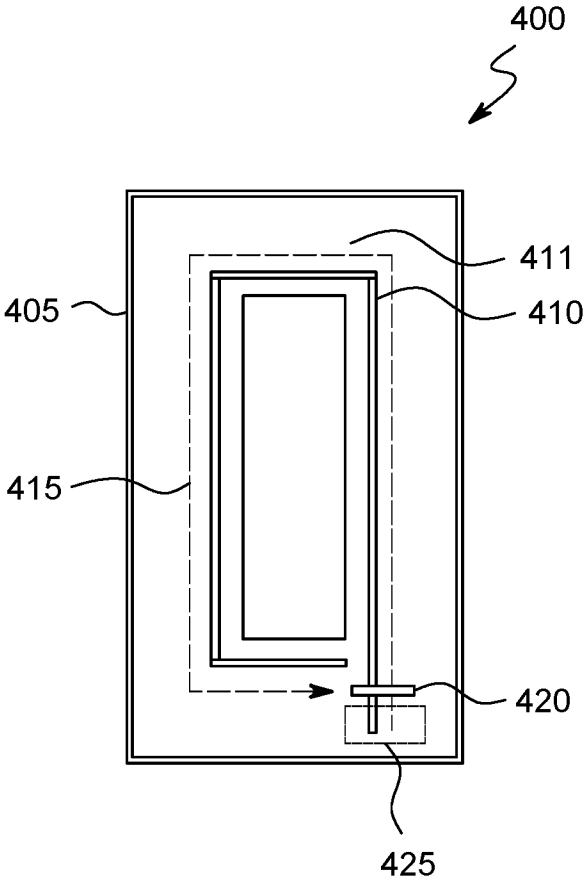

FIG. 4A and FIG. 4B depict aspects of a spray nozzle system 400 with a top view and side view of an embodiment of the invention. Shoe tray/track 405 positions shoe 415 for application of aerosol cleaner, wax, polish and the like from spray nozzle assembly 450. Spray nozzle assembly 450 can include a spray tower or pole that moves along a spray nozzle travel track 410 that can operate to move the spray nozzle assembly 450 forward and return. The spray nozzle assembly 450 sprays aerosol within a travel high and tilt area 411 to cover the top of the shoe 415.

The nozzle assembly 450 can reside in a compartment closed off by a nozzle purge door 420 when the aerosol lines 403 are purged, and an aerosol line purge cloth 425 can absorb the purged liquid. The aerosol lines 403 distribute cleaner, wax, and polish in the form of an aerosol liquid to the spray nozzle assembly 450. An aerosol line connection tee 452 can connect nozzle assembly 450 to aerosol lines 403. Spray lines 403 can include spray line reel/coil housing 451 which reels aerosol lines 403 in and out of the spray line reel/coil housing 451 facilitating movement of the spray nozzle assembly 450 on spray nozzle travel track 410.

Figure 5:
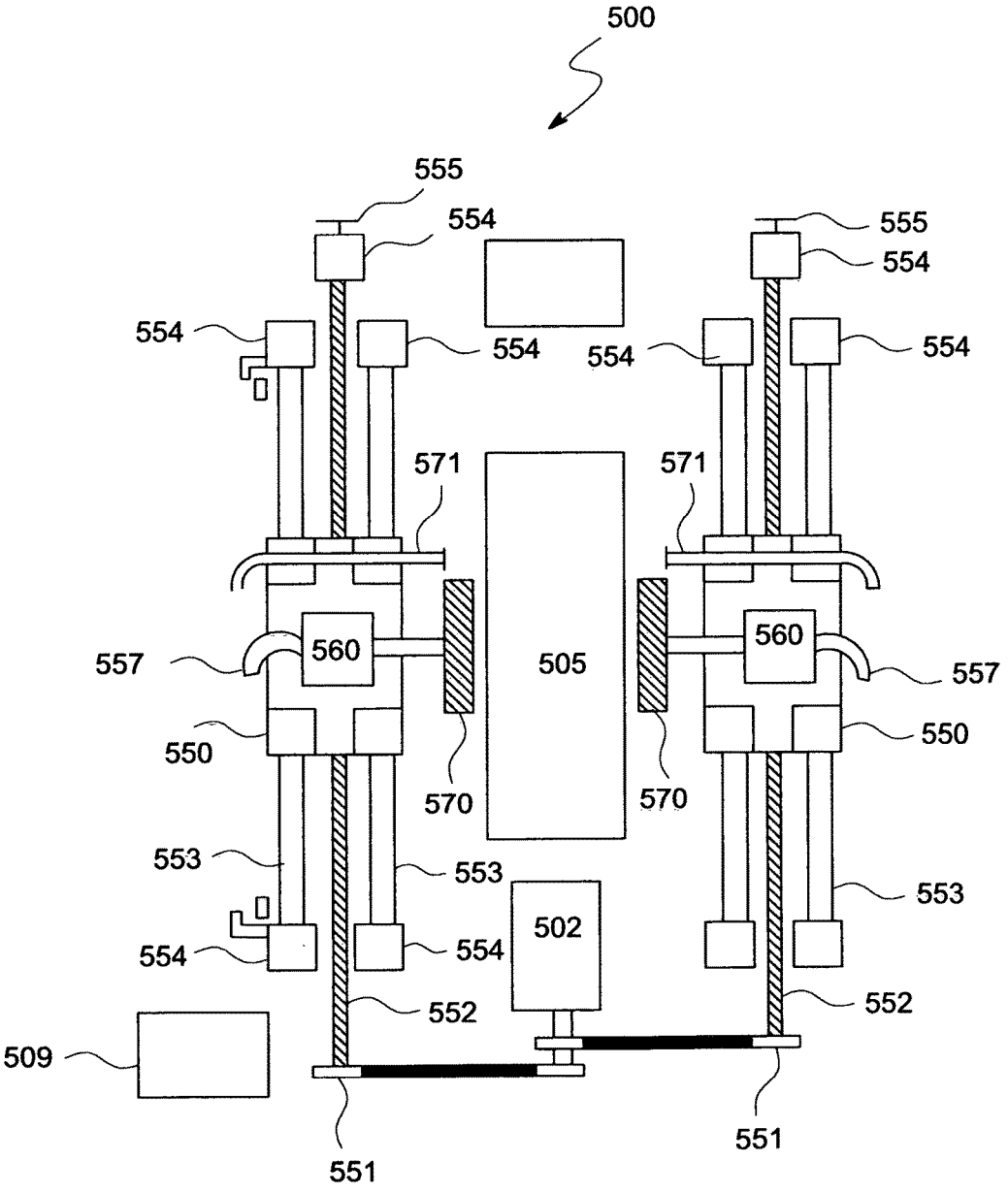
FIG. 5 is a top view of the brush and spray assembly, according to an embodiment of the present invention.

In an exemplary embodiment, FIG. 5 depicts a brush assembly overview providing a system of brushes for cleaning and polishing in the polishing device 100. The brush assembly system 500 can use a drive motor 502 can power a pulley system 551 to power linear movement of brush and spray platforms 550. The brush and spray platforms 550 can move by the pulley system 551 rotating long linear screws 552, which are held in place by anchor couplings 554. One of the anchor couplings 554 for the linear screws 552 can include a counter 555, which can count the number of rotations of linear screw 552 and determine the position of brush and spray platforms 550. The brush and spray platforms 550 can move back and forth along guide rods 553, which are attached to the polishing device 100 by anchoring couplings 554.

Each brush and spray platform 550 can include a brush motor 560 that can rotate brush 570, with an electric power connection 557 that can provide power to brush motor 560. The brush and spray platform can also include an aerosol nozzle 571 for spraying wax, cleaner, or polish onto a shoe, which can be positioned and held in place by shoe track/tray 505, Exhaust fan 509 can be used to help cool the interior of device 100 and evacuate fumes.

In operation, the brush and spray system 500 functions to move brush and spray platforms 550 back and forth along the guide rods 553 while rotating brushes 570 clean/polish a shoe held in place on shoe track/tray 505. The aerosol nozzles 571 can in turn dispense the aerosol mixture corresponding to the cycle the digital control unit (DCU) (not shown) is on, which is then worked onto the shoe surface by brushes 570. That is, a DCU can operate the brush and spray platforms 570 in different operational cycles to clean, wax, and polish shoes, controlling exactly what kind of aerosol dispenses from aerosol nozzles 571, speed of rotation of brushes 570, speed of movement of brush and spray platforms 550, and other operating aspects of the device 100.

Figure 6:
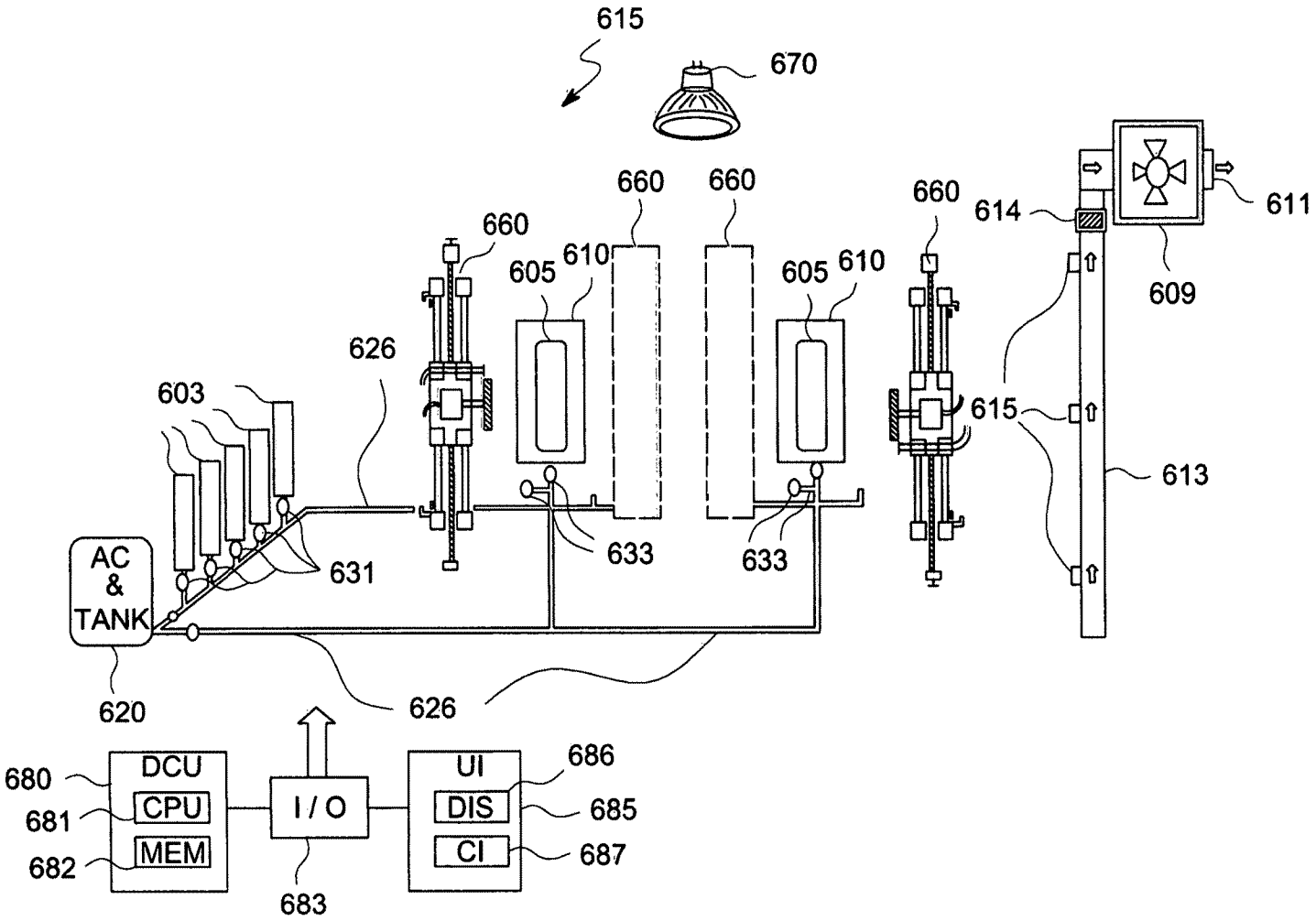
FIG. 6 is an expanded view of the mechanical and electrical components including a DCU, according to an embodiment of the present invention.

In an exemplary embodiment, FIG. 6 depicts a simplified overview of the mechanical and electrical components 600. Shoes 605 can be secured in a shoe track/tray 610, which can be served by the linear moving brush and spray assemblies 660, with four such brush and spray assemblies 660 positioned on each side of two shoes 605 as depicted. Electric motors (not shown) can be used to provide motive power to each brush and spray assemblies 660, with all such movement and functions controlled by a DCU 680 via input/output (I/O) circuitry 683.

The brush and spray assemblies 660 can dispense an aerosol mixture supplied from aerosol wax, cleaner, and polish containers 603 using aerosol supply lines 626. DCU 680 can control solenoids 631 from aerosol wax, cleaner, and polish containers 603 to dispense an aerosol mixture from wax, cleaner, and polish into aerosol supply lines 626. The containers 603 can accommodate and include multiple containers of multiple shades of wax and/or polish to use on different colored shoes 605. A pneumatic system 620 comprised of an air compressor and storage tank provides the necessary air pressure to disperse the aerosols, and solenoids 631 can be controlled supply air to aerosol supply lines 626 by DCU 680. However, mechanical systems can substitute and take the place of pneumatic system 620. A heating lamp 670 can be used to control temperature and enhance the application of various aerosol mixtures.

As previously discussed above, shoe track/tray 610 vertical positioning and securing shoes 605 can be controlled and operated by pneumatic system 620 operating lift pistons and a latching mechanism to secure shoes 605 in shoe track/tray 610. DCU 680 can control the piston and latching components by opening and closing lift and latching solenoids 633. Again, mechanical systems can substitute and take the place of pneumatic system 620 performing these functions.

An exhaust system can be used to extract fumes and help regulate heat inside device 100. The exhaust system can include an air duct system 613 of one or more air ducts 615 leading to vacuum wheel/exhaust fan 609 and exhaust 611. An air filter 614 can filter airflow going into vacuum wheel/exhaust fan 609, and intakes 611 can allow for airflow. The exhaust system can also be operated by the DCU 680 to reverse the vacuum wheel/exhaust fan 609 to draw air in from exhaust 611 to help regulate heat.

A DCU 680 interfaced with the various system and components of polishing device 100 can control operation and implement various cycles of the shoe polishing operation, which can include at least a cleaning, waxing, and polishing cycle. DCU 680 can include central processing unit (CPU) 681 and memory (MEM) 682. Memory 682 can store computer code for operating device 100, executed by CPU 681. In/Out (I/O) circuitry 683 processes digital input and output to and from DCU 680. Output from DCU 680 can control all the various systems and components. I/O circuitry 683 can also connect to a user interface (UI) 685, which can include a display (DIS) 686 and a control interface (CI) 687.

DCU 680 can operate the polishing device to accommodate a shoe profile that can include height of the shoe 605, style of the shoe 605, relative soiling/staining of the shoe 605, size of the shoe 605, and color of the shoe 605. CI 685 can provide for selecting an appropriate operating cycle and sequence according to a selected or entered shoe profile. DCU 680 can then operate the brush and spray assemblies 660 to apply aerosol cleaner, wax, and polish in multiple operational cycles of applying rotating brushes and aerosol spray to accomplish cleaning, waxing, and polishing actions. The brush and spray assemblies 660 can move back and forth alongside the shoe tray and track to in turn clean, wax, and/or polish a secured shoe, and the frequency and duration of each back and forth movement and spraying of aerosol can be controlled by DCU 680. Shoe profiles can be entered via CI 687, and shoe profiles can be stored in memory 682 and can be modified via CI 687 or custom profile entries entered into memory 682 via CI 687.

Although as depicted, the polishing device 100 can operate on two shoes at once, one skilled in the art can readily appreciate that a smaller device for operating on one shoe at a time is possible.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. An automatic shoe polishing device, comprising:

a housing cabinet containing components of the automatic shoe polishing device;

a digital control unit implementing multiple cycles of operation to accommodate multiple shoe profiles;

at least one brush and spray assembly comprising a rotating brush and aerosol spray nozzle mounted on a linear moving platform;

a shoe tray and track comprising a shoe securing mechanism to secure a shoe in place;

a plurality of aerosol containers containing at least a cleaner and polisher mixture;

a pneumatic system used to distribute aerosol mixture and power the aerosol spray nozzle and to power at least one lift piston on the shoe tray and track to accommodate the multiple shoe profiles; and wherein the digital control unit operates the brush and spray assembly in multiple movement and spraying cycles back and forth along the shoe tray and track to in turn clean and polish a secured shoe.

2. The automatic shoe polishing device of claim 1, further comprising an exhaust system to extract fumes from inside the cabinet and help regulate heat in the cabinet.

3. The automatic shoe polishing device of claim 2, wherein the aerosol spray system comprises a spray tower and a spray nozzle travel track.

4. The automatic shoe polishing device of claim 1, wherein the digital control unit stores multiple shoe profiles and a control interface can select an operating cycle to accommodate a shoe profile selected from memory.

5. The automatic shoe polishing device of claim 1, wherein the digital control unit can be used to select and implement an operating cycle to accommodate a shoe profile.

6. The automatic shoe polishing device of claim 1, further comprising the aerosol spray system moving along a travel high and tilt area to cover a top surface of a shoe on the shoe tray and track.

7. The automatic shoe polishing device of claim 1, wherein the plurality of aerosol containers further comprises at least one of a cream and a wax.

8. The automatic shoe polishing device of claim 1, further comprising a pressure stem and disk or plate to fit into and secure the shoe.

9. The automatic shoe polishing device of claim 8, wherein the pressure stem and disk or plate further comprises a balloon cloth inflated in the shoe.

10. The automatic shoe polishing device of claim 1, a heat lamp to provide heat and aid regulating the temperature inside the cabinet during operation.

11. The automatic shoe polishing device of claim 1, wherein the shoe profile includes at least one of— height of the shoe;

style of the shoe;

relative soiling/staining of the shoe;

size of the shoe; and color of the shoe.

12. An automatic shoe polishing device, comprising:

a housing cabinet containing components of the automatic shoe polishing device, a digital control unit implementing multiple cycles of operation to accommodate multiple shoe profiles;

at least one brush and spray assembly comprising a rotating brush and aerosol spray nozzle mounted on a linear moving platform;

a shoe tray and track comprising a shoe securing mechanism to secure a shoe in place;

a plurality of aerosol containers containing at least a cleaner and polisher mixture;

a mechanical system used to distribute aerosol mixture and power the aerosol spray nozzle and to power at least one lift piston on the shoe tray and track to accommodate the multiple shoe profiles; and wherein the digital control unit operates the brush and spray assembly in multiple movement and spraying cycles back and forth along the shoe tray and track to in turn clean and polish a secured shoe.

* * * * *